US008608952B2

(12) United States Patent
Serban et al.

(10) Patent No.: US 8,608,952 B2
(45) **Date of Patent: *Dec. 17, 2013**

(54) PROCESS FOR DE-ACIDIFYING HYDROCARBONS

(75) Inventors: Manuela Serban, Glenview, IL (US); Alakananda Bhattacharyya, Glen Ellyn, IL (US); Beckay J. Mezza, Arlington Heights, IL (US); Kurt M. Vanden Bussche, Lake in the Hills, IL (US); Christopher P. Nicholas, Evanston, IL (US); Warren K. Bennion, Chicago, IL (US)

(73) Assignee: UOP LLC, Des Plaines, IL (US)

( * ) Notice: Subject to any disclaimer, the term of this patent is extended or adjusted under 35 U.S.C. 154(b) by 453 days.

This patent is subject to a terminal disclaimer.

(21) Appl. No.: 12/945,786

(22) Filed: Nov. 12, 2010

(65) Prior Publication Data

US 2011/0155647 A1 Jun. 30, 2011

Related U.S. Application Data

(60) Provisional application No. 61/291,289, filed on Dec. 30, 2009.

(51) Int. Cl.

| | |
|---|---|
| ***C10G 21/06*** | (2006.01) |
| ***C10G 67/04*** | (2006.01) |
| ***C10G 29/20*** | (2006.01) |
| ***C10G 21/20*** | (2006.01) |
| ***C10G 21/24*** | (2006.01) |
| ***C10G 21/28*** | (2006.01) |

(52) U.S. Cl.

USPC ..... 208/263; 208/87; 208/96; 585/860; 585/864

(58) Field of Classification Search

CPC ..... C10G 21/06; C10G 21/08; C10G 21/12; C10G 21/16; C10G 21/18; C10G 21/20; C10G 21/22; C10G 21/24; C10G 21/28

USPC ..... 208/87, 89, 96, 187, 188, 208 R, 211, 208/236, 237, 238, 251 R, 254 R, 262.1, 208/265, 289, 292, 298, 311; 585/860, 864, 585/865, 867

See application file for complete search history.

(56) References Cited

U.S. PATENT DOCUMENTS 2,981,678 A 4/1961 Buningh
4,376,040 A * 3/1983 Sader ..... 208/180

(Continued)

FOREIGN PATENT DOCUMENTS

CN 1657596 A * 8/2005 ..... C10G 33/02
CN 1847366 A * 10/2006 ..... C10G 29/20

(Continued)

OTHER PUBLICATIONS

U.S. Appl. No. 12/945,253, filed Nov. 12, 2010, Serban et al.

(Continued)

*Primary Examiner* — Nina Bhat
*Assistant Examiner* — Jonathan Miller
(74) *Attorney, Agent, or Firm* — Mark Goldberg

(57) ABSTRACT

A process for de-acidifying a hydrocarbon feed includes contacting the hydrocarbon feed containing an organic acid with a feed-immiscible phosphonium ionic liquid to produce a hydrocarbon and feed-immiscible phosphonium ionic liquid mixture and separating the mixture to produce a hydrocarbon effluent having a reduced organic acid content relative to the hydrocarbon feed. Optionally, a de-emulsifier is added to at least one of the contacting and separating steps.

5 Claims, 2 Drawing Sheets

(56) References Cited

U.S. PATENT DOCUMENTS

| | | | | |
|---|---|---|---|---|
| 4,483,763 | A | 11/1984 | Kuk | |
| 4,747,936 | A | 5/1988 | Penning | |
| 4,992,210 | A | 2/1991 | Naeger | |
| 5,494,572 | A * | 2/1996 | Horii et al. | 208/263 |
| 5,817,228 | A | 10/1998 | Greaney et al. | |
| 5,961,821 | A | 10/1999 | Varadaraj et al. | |
| 6,013,176 | A * | 1/2000 | Greaney et al. | 208/251 R |
| 6,096,196 | A | 8/2000 | Varadaraj et al. | |
| 6,139,723 | A | 10/2000 | Pelrine | |
| 6,464,859 | B1 * | 10/2002 | Duncum et al. | 208/263 |
| 6,596,914 | B2 | 7/2003 | Gore | |
| 6,881,325 | B2 | 4/2005 | Morris | |
| 7,001,504 | B2 | 2/2006 | Schoonover | |
| 7,019,188 | B2 * | 3/2006 | Smith et al. | 585/809 |
| 7,198,712 | B2 | 4/2007 | Olivier-Bourbigou | |
| 7,252,756 | B2 | 8/2007 | Gong | |
| 7,553,406 | B2 | 6/2009 | Wasserscheid | |
| 7,749,377 | B2 | 7/2010 | Serban | |
| 7,914,688 | B2 | 3/2011 | Anderson et al. | |
| 8,343,336 | B2 * | 1/2013 | Hamad et al. | 208/237 |
| 2007/0000809 | A1 | 1/2007 | Lin | |
| 2008/0221353 | A1 * | 9/2008 | Tsunashima | 564/12 |
| 2008/0245705 | A1 | 10/2008 | Siskin | |
| 2009/0101592 | A1 | 4/2009 | Anderson et al. | |
| 2009/0288992 | A1 * | 11/2009 | Victorovna Likhanova et al. | 208/237 |
| 2010/0051509 | A1 * | 3/2010 | Martinez Palou et al. | 208/237 |
| 2010/0243532 | A1 | 9/2010 | Myers | |
| 2010/0270211 | A1 * | 10/2010 | Wolny | 208/243 |
| 2011/0203972 | A1 * | 8/2011 | Gargano et al. | 208/236 |

FOREIGN PATENT DOCUMENTS

| | | | | |
|---|---|---|---|---|
| EP | 1854786 | A1 * | 11/2007 | C07D 213/84 |
| JP | 11-241074 | | 9/1999 | |
| WO | WO 2007138307 | A2 * | 12/2007 | C10F 21/27 |

OTHER PUBLICATIONS

U.S. Appl. No. 12/945,303, filed Nov. 12, 2010, Bhattacharyya et al.
U.S. Appl. No. 12/945,752, filed Nov. 12, 2010, Bhattacharyya et al.
U.S. Appl. No. 12/945,765, filed Nov. 12, 2010, Serban et al.
U.S. Appl. No. 12/945,807, filed Nov. 12, 2010, Serban et al.
Xie, Selective Extraction and Identification of Neutral Nitrogen Compounds Contained in Straight-Run Diesel Feed Using Chloride Based Ionic Liquid, Industrial and Engineering Chemistry Research 47(22) 2008, pp. 8801-8807, 2008 American Chemical Society.
Peng, Extraction of Basic Nitrides from FCC Diesel Using Ionic Liquids at Room Temperature, Petroleum Science and Technology 23:9, 2005, pp. 1023-1031, Publisher: Taylor and Francis.
Fan, Review of Researches and Application of Room Temperature Ionic Liquids in Petroleum Industry,Oilfield Chemistry 24(3) 2007, pp. 283-286, China International Book Trading Corp. (abstract in English).
Eber, Deep Desulfurization of Oil Refinery Streams by Extraction with Ionic Liquids, GreenChem., 2004, 6, pp. 316-322, The Royal Society of Chemistry 2004.
Wei, Room Temperature Ionic Liquid as a Novel Medium for Liquid/Liquid Extraction of Metal Ions, Analytica Chimica Acta 488 (2003) pp. 183-192, Elsevier.
Visser, Liquid/Liquid Extraction of Metal Ions in Room Temperature Ionic Liquids, Separation Science and Technology 36(5&6), (2001) Marcel Dekker Inc., pp. 785-804.
Vidal, "Studies on the Use of Ionic Liquids as Potential Extractants of Phenolic Compounds and Metal Ions", Separation Science and Technology, vol. 39, No. 9., pp. 2155-2169, 2004.

* cited by examiner

PROCESS FOR DE-ACIDIFYING HYDROCARBONS

CROSS-REFERENCE TO RELATED APPLICATION

This application claims the benefit of U.S. Provisional Application No. 61/291,289 filed Dec. 30, 2009.

FIELD OF THE INVENTION

The present invention relates to processes for de-acidifying hydrocarbons such as crude oil and hydrocarbon fractions produced from the crude oil. More particularly, the invention relates to such processes using an ionic liquid.

BACKGROUND OF THE INVENTION

Crude oil and hydrocarbon fractions thereof are known to contain organic acids, e.g., naphthenic acids that cause corrosion problems in transportation pipelines and in oil refinery equipment used to process the oil.

In a conventional de-acidification process, an acidic oil, i.e., a hydrocarbon containing a naphthenic acid, is mixed with an alkali such as sodium hydroxide or potassium hydroxide and water. The mixing produces an emulsion which may be separated into an aqueous phase and an oil phase with addition of a de-emulsifier. The neutralization reaction produces an alkali metal salt in the aqueous phase which is removed from the resulting oil phase having a reduced acid content. The acidic oil may be a whole or full range crude that is suitable as feed to a crude distillation zone or an acidic hydrocarbon fraction produced by the crude distillation zone or other process zones in a refinery.

PCT application PCT/GB2007/001985 published as WO 2007/138307 A2 discloses a sulfur-containing acid removal process for deacidifying a crude oil and/or crude oil distillate containing sulfur-containing acids comprising the steps of: (a) contacting the crude oil and/or crude oil distillate containing sulfur-containing acids with a basic ionic liquid having a melting point of below 150° C., and extracting at least a portion of the sulfur-containing acids into the basic ionic liquid as an extract phase; and (b) separating a crude oil and/or crude oil distillate phase which is reduced in acidity from the basic ionic liquid phase.

There remains a need in the art for improved or alternate processes that reduce the acid content of crude oil and acidic hydrocarbon fractions.

SUMMARY OF THE INVENTION

In an embodiment, the invention is a process for de-acidifying a hydrocarbon feed comprising: contacting the hydrocarbon feed containing an organic acid with a feed-immiscible phosphonium ionic liquid to produce a mixture comprising the hydrocarbon and the feed-immiscible phosphonium ionic liquid; separating the mixture to produce a hydrocarbon effluent and a feed-immiscible phosphonium ionic liquid effluent comprising the organic acid; and optionally adding a de-emulsifier to at least one of the contacting step and the separating step.

In another embodiment, the mixture further comprises water in an amount less than 10% relative to the amount of the feed-immiscible phosphonium ionic liquid in the mixture on a weight basis.

In further embodiment the feed-immiscible phosphonium ionic liquid comprises a non-basic ionic liquid.

DETAILED DESCRIPTION OF THE INVENTION

Figure 1:
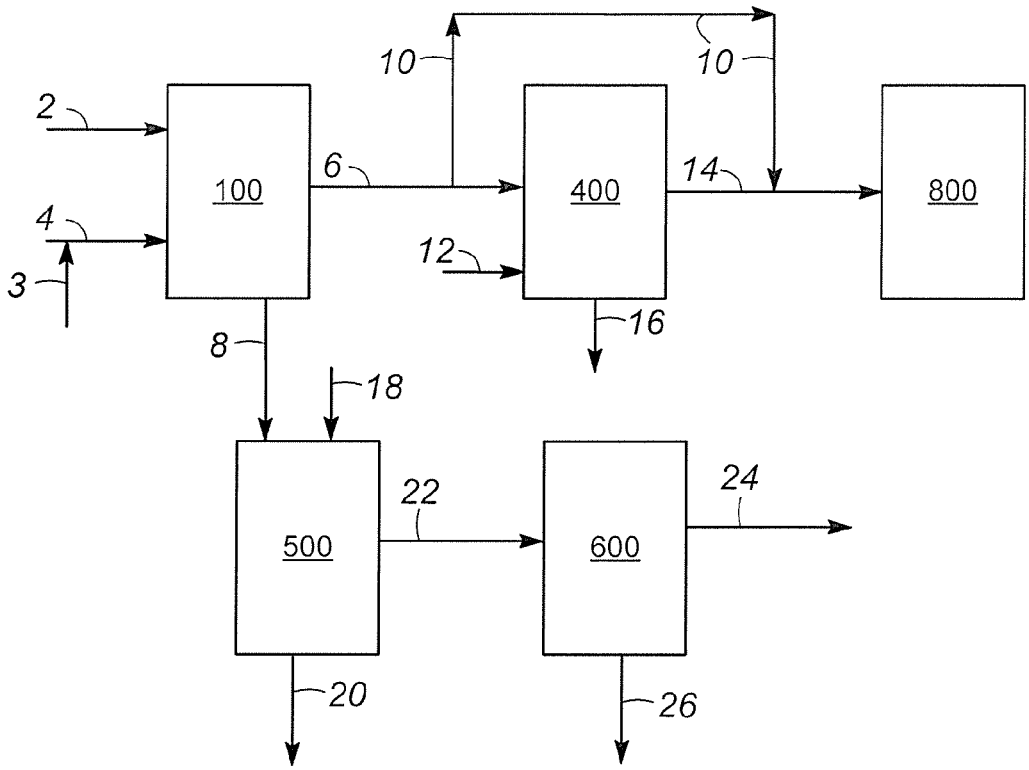
FIG. 1 is a simplified flow scheme illustrating various embodiments of the invention.

In general, the invention may be used to de-acidify, that is, reduce the acid content of a hydrocarbon through use of a feed-immiscible phosphonium ionic liquid. In an exemplary embodiment, the feed-immiscible phosphonium ionic liquid comprises a non-basic ionic liquid.

Hydrocarbons to be de-acidified by processes of this invention contain an organic acid. The hydrocarbon may be any hydrocarbonaceous stream containing one or more organic acid compounds. Examples of organic acids include naphthenic acids, such as cyclopentyl and cyclohexyl carboxylic acids. In an embodiment, the organic acid ranges in molecular weight from about 120 au to about 700 au or higher. The acidity of the hydrocarbon is reported as the Total Acid Number (TAN) in units of mg KOH/g and is determined by ASTM Method D-0664, Acid Number of Petroleum Products by Potentiometric Titration. Unless otherwise noted, the analytical methods used herein such as ASTM D-0664 are available from ASTM International, 100 Barr Harbor Drive, West Conshohocken, Pa., USA. In an embodiment, the hydrocarbon feed to the process has a TAN in the range of from about 0.1 mg KOH/g to about 9 mg KOH/g. In another embodiment, the hydrocarbon has a TAN in the range of from about 0.3 mg KOH/g to about 4 mg KOH/g; and the TAN may range from about 0.5 mg KOH/g to about 8 mg KOH/g.

Processes according to the invention remove an organic acid from the hydrocarbon. That is, the invention removes at least one organic acid compound. It is understood that the hydrocarbon will usually comprise a plurality of organic acid compounds of different types and in various amounts. Thus, the invention removes at least a portion of at least one type of organic acid compound from the hydrocarbon. The invention may remove the same or different amounts of each type of organic acid compound, and some types of organic acid compounds may not be removed. In an embodiment, the organic acid content of the hydrocarbon is reduced by at least 50% based on the Total Acid Numbers of the hydrocarbon introduced to the process and the hydrocarbon effluent from the process. In another embodiment, the organic acid content of the hydrocarbon is reduced by at least 65% based on the Total Acid Numbers of the hydrocarbon introduced to the process and the hydrocarbon effluent from the process; and the organic acid content of the hydrocarbon may be reduced by at least 70% based on the Total Acid Numbers.

The hydrocarbon feed to the process contains an organic acid and may be a single hydrocarbon compound or a mixture of hydrocarbon compounds. In an embodiment, the hydrocarbon comprises a crude oil. As used herein term "crude oil" is to be interpreted broadly to receive not only its ordinary meanings as used by those skilled in the art of producing and refining oil but also in a broad manner to include hydrocarbon mixtures exhibiting crude-like characteristics. Thus, "crude oil" encompasses any full range crude oil produced from an oil field and any full range synthetic crude produced, for example, from tar sand, bitumen, shale oil, and coal. Crude oil may be passed to a crude oil distillation zone wherein the crude oil is fractionated into multiple product streams, such as, light ends, naphtha, diesel, and gas oil. A crude oil distillation zone may comprise multiple distillation columns. In another embodiment, the hydrocarbon comprises a high boiling hydrocarbon fraction, i.e., boiling above the end of the diesel range, including straight run fractions such as atmospheric gas oil, vacuum gas oil, atmospheric crude tower bottoms, vacuum crude tower bottoms and similar boiling fractions. A high boiling hydrocarbon fraction may also be produced by various refining processes such as visbreaking, coking, deasphalting, and fluid catalytic cracking (FCC) processes.

One or more ionic liquids may be used to extract one or more organic acids from a hydrocarbon. Generally, ionic liquids are non-aqueous, organic salts composed of ions where the positive ion is charge balanced with negative ion. These materials have low melting points, often below 100° C., undetectable vapor pressure and good chemical and thermal stability. The cationic charge of the salt is localized over hetero atoms, such as nitrogen, phosphorous, sulfur, arsenic, boron, antimony, and aluminum, and the anions may be any inorganic, organic, or organometallic species.

Ionic liquids suitable for use in the instant invention are feed-immiscible phosphonium ionic liquids. As used herein the term "feed-immiscible phosphonium ionic liquid" means an ionic liquid having a cation comprising at least one phosphorous atom and which is capable of forming a separate phase from the hydrocarbon feed under operating conditions of the process. Ionic liquids that are miscible with hydrocarbon feed at the process conditions will be completely soluble with the hydrocarbon feed; therefore, no phase separation will be feasible. Thus, feed-immiscible phosphonium ionic liquids may be insoluble with or partially soluble with the hydrocarbon feed under operating conditions. A phosphonium ionic liquid capable of forming a separate phase from the hydrocarbon feed under the operating conditions is considered to be feed-immiscible. Ionic liquids according to the invention may be insoluble, partially soluble, or completely soluble (miscible) with water. In an embodiment, the feed-immiscible phosphonium ionic liquid comprises tetrabutylphosphonium methanesulfonate, $[(C_4H_9)_4P]^+[CH_3SO_3]^-$. Tetrabutylphosphonium methanesulfonate is a non-basic ionic liquid. As used herein, the term "non-basic ionic liquid" means an ionic liquid with a pH equal to or less than 7.

In an embodiment, the invention is a process for de-acidifying a hydrocarbon comprising a contacting step and a separating step. In the contacting step, the hydrocarbon feed containing an organic acid is contacted or mixed with a feed-immiscible phosphonium ionic liquid. The contacting may facilitate transfer of the one or more organic acid compounds from the hydrocarbon to the ionic liquid. Although a feed-immiscible phosphonium ionic liquid that is partially soluble with hydrocarbon feed may facilitate transfer of the organic acid from the hydrocarbon feed to the ionic liquid, partial solubility is not required. Insoluble hydrocarbon/feed-immiscible phosphonium ionic liquid mixtures may have sufficient interfacial surface area between the hydrocarbon and ionic liquid to be useful. In the separation step, the mixture of hydrocarbon and feed-immiscible phosphonium ionic liquid settles or forms two phases, a hydrocarbon phase and a feed-immiscible phosphonium ionic liquid phase, which are separated to produce a feed-immiscible phosphonium ionic liquid effluent comprising the organic acid and a hydrocarbon effluent.

In an embodiment, a de-emulsifier is added to the contacting step and/or the separation step to facilitate or enable the phase separation of the hydrocarbon and the feed-immiscible phosphonium ionic liquid, for example, when contacting or mixing the hydrocarbon and the feed-immiscible phosphonium ionic liquid forms or would otherwise form an emulsion. In an embodiment, the de-emulsifier is added to the contacting step simultaneously with the hydrocarbon and/or the feed-immiscible phosphonium ionic liquid. The optional de-emulsifier addition step may be used after an emulsion has formed.

De-emulsifiers suitable for use in the invention are any ethoxylated and/or propoxylated polyamines, di-epoxides or polyols. Examples of such de-emulsifiers include alcohol-based de-emulsifiers available from Baker Petrolite Corporation such as BPR23025 and BPR27330. In an embodiment, the weight ratio de-emulsifier to hydrocarbon feed ranges from about 1:10,000 to about 1:1000. In another embodiment, the weight ratio of de-emulsifier to hydrocarbon feed ranges from about 1:1000 to about 1:10.

Processes of the invention may be conducted in various equipment which are well known in the art and are suitable for batch or continuous operation. For example, in a small scale form of the invention, the hydrocarbon, a feed-immiscible phosphonium ionic liquid, and optionally a de-emulsifier, may be mixed in a beaker, flask, or other vessel, e.g., by stirring, shaking, use of a mixer, or a magnetic stirrer. The mixing or agitation is stopped and the mixture forms a hydrocarbon phase and an ionic liquid phase after settling. In an embodiment, the mixture is centrifuged to facilitate formation of the two phases. The phases can be separated, for example, by decanting or use of a pipette to produce a hydrocarbon effluent having a lower organic acid content relative to the hydrocarbon feed. The process also produces an ionic liquid effluent comprising the one or more organic acid compounds and the feed-immiscible phosphonium ionic liquid.

The contacting and separating steps may be repeated for example when the organic acid content of the hydrocarbon effluent is to be reduced further to obtain a desired organic acid content in the ultimate hydrocarbon product stream from the process. Each set, group, or pair of contacting and separating steps may be referred to as an acid removal step. Thus, the invention encompasses processes having single and multiple acid removal steps.

An acid removal zone may be used to perform an acid removal step. As used herein, the term "zone" can refer to one or more equipment items and/or one or more sub-zones. Equipment items may include, for example, one or more vessels, heaters, separators, exchangers, conduits, pumps, compressors, and controllers. Additionally, an equipment item can further include one or more zones or sub-zones. The acid removal process or step may be conducted in a similar manner and with similar equipment as is used to conduct other liquid-liquid wash and extraction operations. Suitable equipment includes, for example, columns with: trays, packing, rotating discs or plates, and static mixers. Pulse columns and mixing/settling tanks may also be used.

Figure 2A:
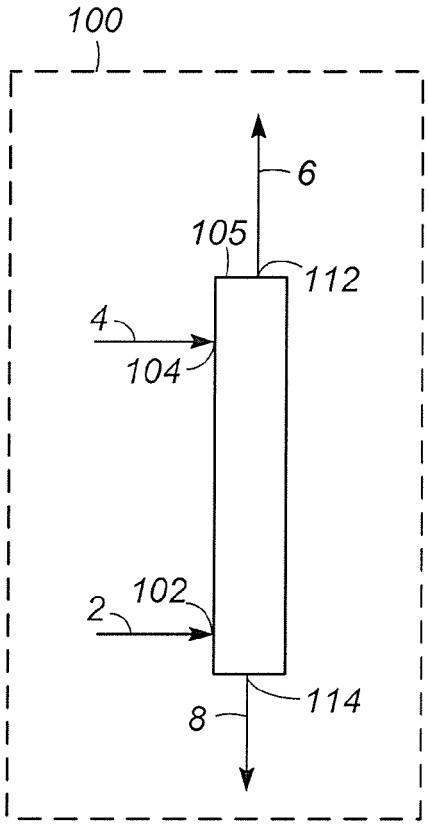
FIGS. 2A and 2B are simplified flow schemes illustrating different embodiments of an extraction zone of the invention.

FIG. 2A illustrates an embodiment of the invention which may be practiced in acid removal zone 100 that comprises a multi-stage, counter-current extraction column 105 wherein the hydrocarbon and the feed-immiscible phosphonium ionic liquid are contacted and separated. Hydrocarbon feed stream 2 enters extraction column 105 through hydrocarbon feed inlet 102 and lean ionic liquid stream 4 enters extraction column 105 through ionic liquid inlet 104. In the Figures, reference numerals of the streams and the lines or conduits in which they flow are the same. Hydrocarbon feed inlet 102 is located below ionic liquid inlet 104. The hydrocarbon effluent passes through hydrocarbon effluent outlet 112 in an upper portion of extraction column 105 to hydrocarbon effluent conduit 6. The ionic liquid effluent including the organic acid removed from the hydrocarbon feed passes through ionic liquid effluent outlet 114 in a lower portion of extraction column 105 to ionic liquid effluent conduit 8. The optional de-emulsifier may be included in either one or both of hydrocarbon feed stream 2 and lean ionic liquid stream 4. In another embodiment, the de-emulsifier is added to extraction column 105 by a separate conduit not shown.

Consistent with common terms of art, the ionic liquid introduced to the acid removal step may be referred to as a "lean ionic liquid" generally meaning a feed-immiscible phosphonium ionic liquid that is not saturated with one or more extracted organic acid compounds. Lean ionic liquid may include one or both of fresh and regenerated ionic liquid and is suitable for accepting or extracting organic acid from the hydrocarbon feed. Likewise, the ionic liquid effluent may be referred to as "rich ionic liquid", which generally means a feed-immiscible phosphonium ionic liquid effluent produced by an acid removal step or process or otherwise including a greater amount of extracted organic acid compounds than the amount of extracted organic acid compounds included in the lean ionic liquid. A rich ionic liquid may require regeneration or dilution, e.g., with fresh ionic liquid, before recycling the rich ionic liquid to the same or another acid removal step of the process.

Figure 2B:
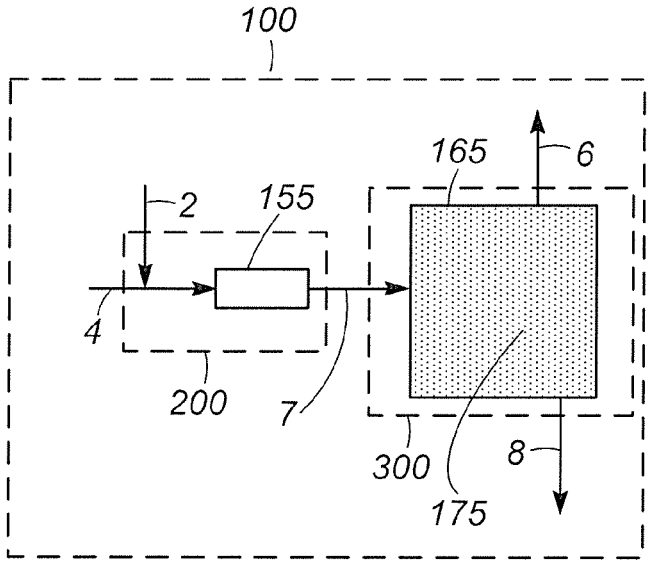

FIG. 2B illustrates another embodiment of acid removal washing zone 100 that comprises a contacting zone 200 and a separation zone 300. In this embodiment, lean ionic liquid stream 4 and hydrocarbon feed stream 2 are introduced into the contacting zone 200 and mixed by introducing hydrocarbon feed stream 2 into the flowing lean ionic liquid stream 4 and passing the combined streams through static in-line mixer 155. Static in-line mixers are well known in the art and may include a conduit with fixed internals such as baffles, fins, and channels that mix the fluid as it flows through the conduit. In other embodiments, not illustrated, lean ionic liquid stream 4 may be introduced into hydrocarbon feed stream 2, or the lean ionic liquid stream 4 and hydrocarbon feed stream may be combined such as through a "Y" conduit. In another embodiment, lean ionic liquid stream 4 and hydrocarbon feed stream 2 are separately introduced into the static in-line mixer 155. In other embodiments, the streams may be mixed by any method well know in the art including stirred tank and blending operations. The mixture comprising hydrocarbon and ionic liquid is transferred to separation zone 300 via transfer conduit 7. Separation zone 300 comprises separation vessel 165 wherein the two phases are allowed to separate into a rich ionic liquid phase which is withdrawn from a lower portion of separation vessel 165 via ionic liquid effluent conduit 8 and the hydrocarbon phase is withdrawn from an upper portion of separation vessel 165 via hydrocarbon effluent conduit 6. Separation vessel 165 may comprise a boot, not illustrated, from which rich ionic liquid is withdrawn via conduit 8. In an embodiment, a de-emulsifier may be included in either one or both of hydrocarbon feed stream 2 and lean ionic liquid stream 4. In another an embodiment, the de-emulsifier is added to contacting zone 200 by a separate conduit not shown. In yet another embodiment, the de-emulsifier is added to the separation zone 300 or transfer conduit 7 by a conduit not shown.

Separation vessel 165 may contain a solid media 175 and/or other coalescing devices which facilitate the phase separation. In other embodiments the separation zone 300 may comprise multiple vessels which may be arranged in series, parallel, or a combination thereof. The separation vessels may be of any shape and configuration to facilitate the separation, collection, and removal of the two phases. In a further embodiment not illustrated, acid removal zone 100 may include a single vessel wherein lean ionic liquid stream 4 and hydrocarbon feed stream 2 are mixed, then remain in the vessel to settle into the hydrocarbon effluent and rich ionic liquid phases. In an embodiment the process comprises at least two acid removal steps. For example, the hydrocarbon effluent from one acid removal step may be passed directly as the hydrocarbon feed to a second acid removal step. In another embodiment, the hydrocarbon effluent from one acid removal step may be treated or processed before being introduced as the hydrocarbon feed to the second acid removal step. There is no requirement that each acid removal zone comprises the same type of equipment. Different equipment and conditions may be used in different acid removal zones.

The acid removal step may be conducted under acid removal conditions including temperatures and pressures sufficient to keep the feed-immiscible phosphonium ionic liquid and hydrocarbon feeds and effluents as liquids. For example, the acid removal step temperature may range between about 10° C. and less than the decomposition temperature of the ionic liquid; and the pressure may range between about atmospheric pressure and 700 kPa(g). When the feed-immiscible phosphonium ionic liquid comprises more than one ionic liquid component, the decomposition temperature of the ionic liquid is the lowest temperature at which any of the ionic liquid components decompose. The acid removal step may be conducted at a uniform temperature and pressure or the contacting and separating steps of the acid removal step may be operated at different temperatures and/or pressures. In an embodiment, the contacting step is conducted at a first temperature, and the separating step is conducted at a temperature at least 5° C. lower than the first temperature. In a non limiting example, the first temperature is about 70° C. and the second temperature is about 25° C. Such temperature differences may facilitate separation of the hydrocarbon and ionic liquid phases.

The above and other acid removal step conditions such as the contacting or mixing time, the separation or settling time, and the ratio of hydrocarbon feed to feed-immiscible phosphonium ionic liquid (lean ionic liquid) may vary greatly based, for example, on the nature of the hydrocarbon feed, the acid content of the hydrocarbon feed, the degree of acid removal required, the number of acid removal steps employed, and the specific equipment used. In general it is expected that contacting time may range from less than one minute to about two hours; settling time may range from about one minute to about eight hours; and the weight ratio of hydrocarbon feed to lean ionic liquid may range from 1:1,000 to 1,000:1. In an embodiment, the weight ratio of hydrocarbon feed to lean ionic liquid may range from about 1:100 to about 100:1; and the weight ratio of hydrocarbon feed to lean ionic liquid may range from about 1:10 to about 10:1. In an embodiment the weight of hydrocarbon feed is greater than the weight of the lean ionic liquid.

In an embodiment, more than about 40% of the acid may be extracted or removed from the hydrocarbon feed 2 in a single acid removal step as determined by the Total Acid Numbers of the hydrocarbon feed 2 and the hydrocarbon effluent 6. That is, the Total Acid Number of the hydrocarbon effluent 6 is less than about 60% of the Total Acid Number of the hydrocarbon feed 2. In another embodiment, the Total Acid Number of the hydrocarbon effluent 6 is less than about 50% of the Total Acid Number of the hydrocarbon feed 2; and the Total Acid Number of the hydrocarbon effluent 6 may be less than about 40% of the Total Acid Number of the hydrocarbon feed 2. The degree of phase separation between the hydrocarbon and ionic liquid phases is another factor to consider as it affects recovery of the ionic liquid and hydrocarbon. The degree of acid removed and the recovery of the hydrocarbon and ionic liquids may be affected differently by the nature of the hydrocarbon feed, the de-emulsifier, if used, the equipment, and the acid removal conditions such as those discussed above.

The amount of water present in the hydrocarbon/ionic liquid mixture during the acid removal step may also affect the amount of organic acid removed and/or the degree of phase separation or recovery of the hydrocarbon and ionic liquid. In an embodiment, the hydrocarbon/feed-immiscible phosphonium ionic liquid mixture has a water content of less than about 10% relative to the weight of the feed-immiscible phosphonium ionic liquid. In another embodiment, the water content of the hydrocarbon/feed-immiscible phosphonium ionic liquid mixture is less than about 5% relative to the weight of the feed-immiscible phosphonium ionic liquid; and the water content of the hydrocarbon/feed-immiscible phosphonium ionic liquid mixture may be less than about 2% relative to the weight of the feed-immiscible phosphonium ionic liquid. In a further embodiment, the hydrocarbon/feed-immiscible phosphonium ionic liquid mixture is water free, i.e. the mixture does not contain water.

FIG. 1 is a flow scheme illustrating various embodiments of the invention and some of the optional and/or alternate steps and apparatus encompassed by the invention. Hydrocarbon feed stream 2 and the feed-immiscible phosphonium ionic liquid stream 4 are introduced to and contacted and separated in acid removal zone 100 to produce ionic liquid effluent stream 8 and hydrocarbon effluent stream 6 as described above. The ionic liquid stream 4 may be comprised of fresh ionic liquid stream 3 and/or an ionic liquid stream which may be recycled in the process as described below. The optional de-emulsifier may be added to acid removal zone 100 in any convenient manner such as those discussed above to enable or facilitate the phase separation. In an embodiment, a portion or all of hydrocarbon effluent stream 6 is passed via conduit 10 to a crude oil distillation zone 800.

An optional hydrocarbon washing step may be used, for example, to recover ionic liquid that is entrained or otherwise remains in the hydrocarbon effluent stream by using water to wash or extract the ionic liquid from the hydrocarbon effluent. In this embodiment, a portion or all of hydrocarbon effluent stream 6 (as feed) and a water stream 12 (as solvent) are introduced to hydrocarbon washing zone 400. The hydrocarbon effluent and water streams introduced to hydrocarbon washing zone 400 are mixed and separated to produce a washed hydrocarbon stream 14 and a spent water stream 16, which comprises the ionic liquid. The hydrocarbon washing step may be conducted in a similar manner and with similar equipment as used to conduct other liquid-liquid wash and extraction operations as discussed above. Various hydrocarbon washing step equipment and conditions such as temperature, pressure, times, and solvent to feed ratio may be the same as or different from the acid removal zone equipment and conditions. In general, the hydrocarbon washing step conditions will fall within the same ranges as given above for the acid removal step conditions. A portion or all of the washed hydrocarbon stream 14 may be passed to crude oil distillation zone 800.

An optional ionic liquid regeneration step may be used, for example, to regenerate the ionic liquid by removing the organic acid compound from the ionic liquid, i.e. reducing the organic acid content of the rich ionic liquid. In an embodiment, a portion or all of ionic liquid effluent stream 8 (as feed) comprising the feed-immiscible phosphonium ionic liquid and the organic acid and a regeneration solvent stream 18 are introduced to ionic liquid regeneration zone 500. The ionic liquid effluent and regeneration solvent streams are mixed and separated to produce an extract stream 20 comprising the organic acid compound, and a regenerated ionic liquid stream 22. The ionic liquid regeneration step may be conducted in a similar manner and with similar equipment as used to conduct other liquid-liquid wash and extraction operations as discussed above. Various ionic liquid regeneration step conditions such as temperature, pressure, times, and solvent to feed may be the same as or different from the acid removal conditions. In general, the ionic liquid regeneration step conditions will fall within the same ranges as given above for the acid removal step conditions.

In an embodiment, the regeneration solvent stream 18 comprises a hydrocarbon fraction lighter than the hydrocarbon feed stream 2. The lighter hydrocarbon fraction may consist of a single hydrocarbon compound or may comprise a mixture of hydrocarbons. In an embodiment, the lighter hydrocarbon fraction comprises at least one of a naphtha, gasoline, diesel, light cycle oil (LCO), and light coker gas oil (LCGO) hydrocarbon fraction. The lighter hydrocarbon fraction may comprise straight run fractions and/or products from conversion processes such as hydrocracking, hydrotreating, fluid catalytic cracking (FCC), reforming, coking, and visbreaking. In this embodiment, extract stream 20 comprises the lighter hydrocarbon regeneration solvent and the organic acid compound. In another embodiment, the regeneration solvent stream 18 comprises water and the ionic liquid regeneration step produces extract stream 20 comprising the organic acid compound and regenerated ionic liquid 22 comprising water and the feed-immiscible phosphonium ionic liquid. In an embodiment wherein regeneration solvent stream 18 comprises water, a portion or all of spent water stream 16 may provide a portion or all of regeneration solvent stream 18. Regardless of whether regeneration solvent stream 18 comprises a lighter hydrocarbon fraction or water, a portion or all of regenerated ionic liquid stream 22 may be recycled to the acid removal step via a conduit not shown consistent with other operating conditions of the process. For example, a constraint on the water content of the ionic liquid stream 4 or ionic liquid/hydrocarbon mixture in acid removal zone 100 may be met by controlling the proportion and water content of fresh and recycled ionic liquids.

Optional ionic liquid drying step is illustrated by drying zone 600. The ionic liquid drying step may be employed to reduce the water content of one or more of the streams comprising ionic liquid to control the water content of the acid removal step as described above. In the embodiment of FIG. 1, a portion or all of regenerated ionic liquid stream 22 is introduced to drying zone 600. Although not shown, other streams comprising ionic liquid such as the fresh ionic liquid stream 3, ionic liquid effluent stream 8, and spent water stream 16, may also be dried in any combination in drying zone 600. To dry the ionic liquid stream or streams water may be removed by one or more various well known methods including distillation, flash distillation, and using a dry inert gas to strip water. Generally, the drying temperature may range from about 100° C. to less than the decomposition temperature of the ionic liquid and the pressure may range from about 35 kPa(g) to about 250 kPa(g). The drying step produces a dried ionic liquid stream 24 and a drying zone water effluent stream 26. Although not illustrated, a portion or all of dried ionic liquid stream 24 may be recycled or passed to provide all or a portion of the ionic liquid 4 introduced to acid removal zone 100. A portion or all of drying zone water effluent stream 26 may be recycled or passed to provide all or a portion of the water introduced into hydrocarbon washing zone 400 and/or ionic liquid regeneration zone 500.

Unless otherwise stated, the exact connection point of various inlet and effluent streams within the zones is not essential to the invention. For example, it is well known in the art that a stream to a distillation zone may be sent directly to the column, or the stream may first be sent to other equipment within the zone such as heat exchangers, to adjust temperature, and/or pumps to adjust the pressure. Likewise, streams entering and leaving washing or extraction zones including acid removal zone 100, hydrocarbon washing zone 400, and ionic liquid regeneration zone 500 may pass through ancillary equipment such as heat exchanges within the zones. Streams, including recycle streams, introduced to washing or extraction zones may be introduced individually or combined prior to or within such zones.

The invention encompasses a variety of flow scheme embodiments including optional destinations of streams, splitting streams to send the same composition, i.e. aliquot portions, to more than one destination, and recycling various streams within the process. Examples include: various streams comprising ionic liquid and water may be dried and/or passed to other zones to provide all or a portion of the water and/or ionic liquid required by the destination zone. The various process steps may be operated continuously and/or intermittently as needed for a given embodiment, e.g., based on the quantities and properties of the streams to be processed in such steps. As discussed above the invention encompasses multiple acid removal steps, which may be performed in parallel, sequentially, or a combination thereof. Multiple acid removal steps may be performed within the same acid removal zone and/or multiple acid removal zones may be employed with or without intervening washing, regeneration and/or drying zones.

EXAMPLES

The examples are presented to further illustrate some aspects and benefits of the invention and are not to be considered as limiting the scope of the invention.

Example 1

A commercial sample of a Medium Arabian Crude Oil having the following properties was obtained for use as the hydrocarbon feed stream: Total Acid Number of 0.116 mg KOH/g, 128 ppm water; 1000 ppm nitrogen, 2.88% sulfur. The Total Acid Number was determined by ASTM Method D-0664, Acid Number of Petroleum Products by Potentiometric Titration. The water content was determined by ASTM Method D1364-02, Karl Fisher Reagent Titration. The nitrogen content was determined by ASTM Method D4629-02, Trace Nitrogen in Liquid Petroleum Hydrocarbons by Syringe/Inlet Oxidative Combustion and Chemiluminescence Detection. The sulfur content was determined by ASTM Method D5453-00, Ultraviolet Fluorescence.

Examples 2-5

The Medium Arabian Crude Oil of Example 1, the ionic liquid listed in Table 1 and a de-emulsifier containing butanol (BPR 27330 from Baker Petrolite Corporation) in a weight ratio of Medium Arabian Crude Oil to ionic liquid to de-emulsifier of 1:0.5:0.05 were mixed at a pressure of 43 kPa(g) for two hours at 300 rpm using a digital magnetic stirrer hot plate. Examples 3 and 4 were mixed at 50° C. and Examples 2 and 5 were mixed at 70° C. After mixing was stopped, the mixtures were centrifuged for 5 minutes at 25° C., then a sample of the hydrocarbon phase (hydrocarbon effluent) was removed with a pipette and analyzed by for Total Acid Number by ASTM Method D-0664. The results are compared in Table 1.

TABLE 1

| Example | Ionic Liquid | TAN, mg KOH/g |
|---|---|---|
| 2 | tetrabutylphosphonium methanesulfonate | 0.023 |
| 3 | 1-ethyl-3-methylimidazolium hydrogen sulfate (comparative) | TAN increased |
| 4 | 1-butyl-3-methylimidazolium hydrogen sulfate (comparative) | TAN increased |
| 5 | 1-butyl-4-methylpyridinium hexafluorophosphate (comparative) | TAN increased |

Example 2 demonstrates that processes of the invention using a feed-immiscible phosphonium ionic liquid may provide up to 80% removal of organic acids from a hydrocarbon as determined by the Total Acid Numbers of the hydrocarbon feed and effluent. Example 2 is a non-basic ionic liquid. However, comparative Examples 3-5 using non-basic imidazolium and pyridinium ionic liquids did not remove organic acids from the hydrocarbon feed at the conditions employed, but caused a net increase in the Total Acid Number of the hydrocarbon.

The invention claimed is:

1. A process for de-acidifying a hydrocarbon feed comprising:

(a) contacting the hydrocarbon feed containing an organic acid with a feed-immiscible phosphonium ionic liquid to produce a mixture comprising the hydrocarbon and the feed-immiscible phosphonium ionic liquid;

(b) separating the mixture to produce a hydrocarbon effluent and a feed-immiscible phosphonium ionic liquid effluent, the feed-immiscible phosphonium ionic liquid effluent comprising the organic acid; and (c) optionally adding a de-emulsifier to at least one of the contacting step (a) and the separating step (b);

wherein the feed immiscible phosphonium ionic liquid comprises tetrabutylphosphonium methanesulfonate; and wherein the organic acid content of the hydrocarbon is reduced by at least 65-70% based on the Total Acid Numbers of the hydrocarbon feed;

further comprising contacting the ionic liquid effluent with a regeneration solvent and separating the ionic liquid effluent from the regeneration solvent to produce an extract stream comprising the organic acid and a regenerated ionic liquid stream comprising the feed-immiscible phosphonium ionic liquid, wherein the regeneration solvent comprises water and the regenerated ionic liquid stream further comprises water and wherein the hydrocarbon effluent comprises the feed-immiscible phosphonium ionic liquid, the process further comprising washing at least a portion of the hydrocarbon effluent with water to produce a washed hydrocarbon effluent and a spent water stream, the spent water stream comprising the feed-immiscible phosphonium ionic liquid; wherein at least a portion of the spent water stream is at least a portion of the regeneration solvent.

2. The process of claim 1 further comprising drying at least a portion of at least one of the regenerated ionic liquid stream, and the spent water stream to produce a dried ionic liquid stream.

3. The process of claim 2 further comprising recycling at least a portion of the dried ionic liquid stream to the contacting step.

4. A process for de-acidifying a hydrocarbon feed comprising:

(a) contacting the hydrocarbon feed containing an organic acid with a feed-immiscible phosphonium ionic liquid to produce a mixture comprising the hydrocarbon and the feed-immiscible phosphonium ionic liquid;

(b) separating the mixture to produce a hydrocarbon effluent and a feed-immiscible phosphonium ionic liquid effluent, the feed-immiscible phosphonium ionic liquid effluent comprising the organic acid;

(c) optionally adding a de-emulsifier to at least one of the contacting step (a) and the separating step (b); and at least one of:

(d) washing at least a portion of the hydrocarbon effluent with water to produce a washed hydrocarbon stream and a spent water stream;

(e) contacting the ionic liquid effluent with a regeneration solvent and separating the ionic liquid effluent from the regeneration solvent to produce an extract stream comprising the organic acid and a regenerated ionic liquid stream; and (f) drying at least a portion of at least one of the ionic liquid effluent, the spent water stream, and the regenerated ionic liquid stream to produce a dried ionic liquid stream.

5. The process of claim 4 further comprising recycling at least a portion of at least one of the ionic liquid effluent, the spent water stream, the regenerated ionic liquid stream, and the dried ionic liquid stream to the contacting step.

* * * * *